US006756727B2

(12) United States Patent
Bechtel et al.

(10) Patent No.: US 6,756,727 B2
(45) Date of Patent: Jun. 29, 2004

(54) COLOR PICTURE SCREEN WITH COLOR FILTER

(75) Inventors: Hans-Helmut Bechtel, Roetgen (DE); Harald Gläser, Aachen (DE); Joachim Opitz, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 313 days.

(21) Appl. No.: 09/840,211

(22) Filed: Apr. 23, 2001

(65) Prior Publication Data

US 2001/0050527 A1 Dec. 13, 2001

(30) Foreign Application Priority Data

Apr. 26, 2000 (DE) ..... 100 20 326

(51) Int. Cl.[7] ..... H01J 29/10
(52) U.S. Cl. ..... 313/467; 313/466; 313/474
(58) Field of Search ..... 313/467, 466, 313/474, 477, 110, 112, 106; 430/27, 7; 445/24; 368/78; 359/891, 805

(56) References Cited

U.S. PATENT DOCUMENTS 2,543,477 A * 2/1951 Sziklai et al. ..... 250/164
3,911,479 A * 10/1975 Sakurai et al. ..... 178/5.4
4,757,231 A * 7/1988 Kato et al. ..... 313/466
5,340,673 A * 8/1994 Tateyama ..... 420/23
5,543,685 A * 8/1996 Okamoto et al. ..... 313/496
5,606,462 A * 2/1997 Tsuruoka et al. ..... 359/891
5,871,873 A * 2/1999 Van Doorn et al. ..... 313/461
5,939,821 A * 8/1999 Itou et al. ..... 313/461
5,942,848 A * 8/1999 Van Doorn et al. ..... 313/461
5,952,137 A * 9/1999 Ihara et al. ..... 430/27
5,955,226 A * 9/1999 Matsuda et al. ..... 430/25
6,140,758 A * 10/2000 Matsauda et al. ..... 313/466
6,341,862 B1 * 1/2002 Miyazaki et al. ..... 347/106

FOREIGN PATENT DOCUMENTS

DE 2731826 * 1/1979 ..... H01J/29/32

* cited by examiner

*Primary Examiner*—Alexander Gilman

(57) ABSTRACT

The invention describes a color picture screen with an enhanced contrast. The color picture screen comprises a color filter layer between the picture screen glass and the phosphor layer, which filter layer comprises a red pigment in the areas of the red phosphors, a blue pigment in the areas of the blue phosphors, and a blue or a red pigment in the areas of the green phosphors.

7 Claims, 4 Drawing Sheets

COLOR PICTURE SCREEN WITH COLOR FILTER

Figure 1:
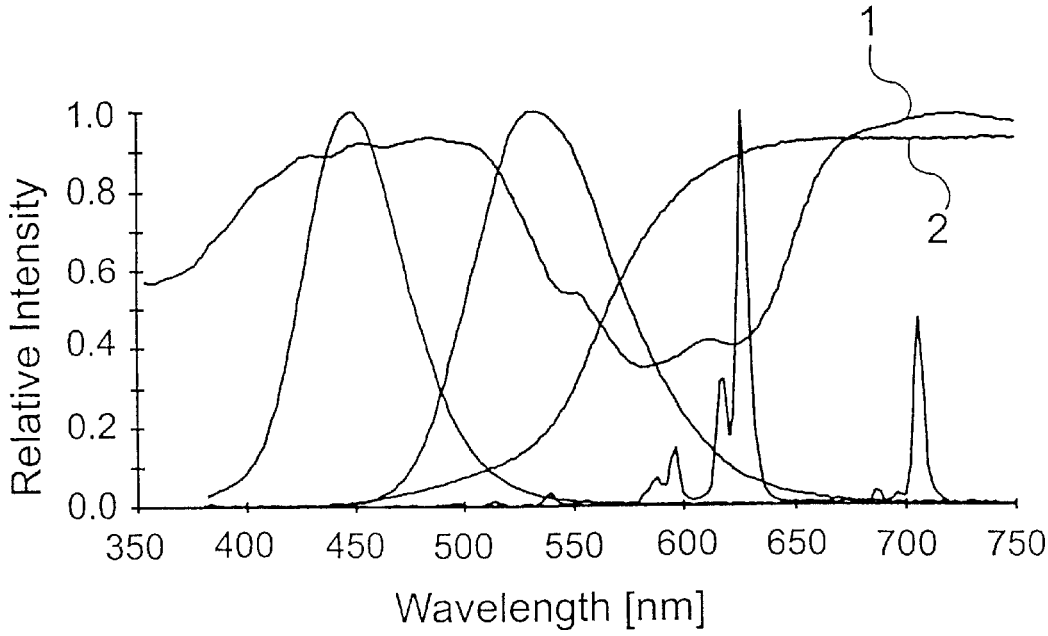

The invention relates to a color picture screen, in particular for a color cathode ray tube or a color monitor, provided with a picture screen glass, a phosphor layer which is provided on the inner surface of the picture screen glass and comprises red, green, and blue phosphors, and with a color filter layer between the picture screen glass and the phosphor layer.

Color picture screens and color monitors are often used in bright ambient light. Their picture screens should be free from glare, low-reflection, and rich in contrast so as to be better visible under these light conditions and to be less tiring on the eyes.

It is important for achieving a sufficient picture contrast in daylight that the color picture screen should have a highest possible luminance accompanied by a lowest possible reflection of external light. The characteristic quantity defining this property is the so-called Luminance Contrast Performance (LCP):

$$LCP = \frac{\text{Luminance } (L)}{\sqrt{\text{Reflection } (R)}}$$

An increase in the contrast and accordingly an improvement of the LCP value may be achieved, for example, by means of color filters in the form of inorganic pigments, which are chosen such that they are as transparent as possible to the color emitted by the respective phosphor while absorbing the remaining spectral components. These color filters are provided as separate layers between the phosphor layer and the picture screen. Thus the green and blue components of the incident ambient light are absorbed by a red pigment, the blue and red components by a green pigment, and the green and red components by a blue pigment. In addition, these transparent color filters improve the color purity of the light emitted by the phosphor.

The green pigments used as green color filters contribute very little to the improvement of the LCP value in many cases. U.S. Pat. No. 5,942,848 describes a color picture screen which comprises no color filter between the green phosphor and the picture screen.

It is an object of the present invention to provide a color picture screen which supplies a picture which is rich in contrast.

The object is achieved by means of a color picture screen provided with a picture screen glass, a phosphor layer which is provided on the inner surface of the picture screen glass and comprises red, green, and blue phosphors, and with a color filter layer between the picture screen glass and the phosphor layer, which color filter layer comprises a red color filter layer in the region of the red phosphors in the phosphor layer, a blue color filter layer in the region of the blue phosphors in the phosphor layer, and a blue or a red color filter layer in the region of the green phosphors.

Surprisingly, the red or blue color filter layer in the region of the green-emitting phosphors has advantageous effects. Thus the LCP value of the entire color picture screen is improved. With a red color filter layer between the picture screen glass and the green phosphor, furthermore, the color point of the emitted green light is shifted to higher x-values, i.e. into the yellow region. By contrast, the color point is shifted towards the green spectral region with a blue color filter layer in the region of the green phosphors. The total range of colors that can be displayed can be increased thereby. In addition, the color of the color picture screen when not in use, the so-called body color, can be varied over a wider range.

It is preferred that the thickness of the red color filter layer in the region of the green phosphors is smaller than the thickness of the red color filter layer in the region of the red phosphors.

It is also preferred that the thickness of the blue color filter layer in the region of the green phosphors is smaller than the thickness of the blue color filter layer in the region of the blue phosphors.

The LCP value is particularly strongly improved in these two embodiments.

It is furthermore preferred that the blue color filter layer comprises a pigment chosen from the group of $CoO—Al_2O_3$ and ultramarine pigments.

It is furthermore preferred that the red color filter layer comprises a pigment chosen from the group of $Fe_2O_3$, TaON, and CdS—CdSe.

All these pigments are transparent in portions of the emission range of the green phosphor.

It is particularly highly preferred that the pigments have an average particle diameter smaller than 200 nm.

Pigments with a particle diameter smaller than 200 nm show no undesirable scattering of the visible light.

It may be advantageous that a black matrix is provided on the picture screen glass.

A black matrix improves the contrast of the picture displayed on the picture screen in that external incident visible light is absorbed.

The invention will be explained in more detail below with reference to eight Figures, and nine embodiments are described. In the drawing:

FIG. 1 shows the emission bands of a blue, a red, and a green phosphor as well as the transmission bands of a red and a blue pigment, and FIGS. 2 to 8 show the CIE color points of the red, blue, and green phosphors.

To manufacture a color filter layer, a suitable pigment is dispersed in water by means of a stirring or milling device, during which dispersing agents are added. A suspension of primary particles with an average diameter below 200 nm is obtained. This suspension is filtered so as to remove impurities such as dust, detritus from milling tools, or hard agglomerates of the pigments used. All impurities larger than the eventual layer thickness of the color filter are removed from the suspension through a suitable choice of the mesh of the filter. If further additives such as, for example, organic binders or an anti-foaming agent were added to the suspension, it is advantageous to filter the respective additive solutions beforehand.

The color filter layer may be deposited and structured by means of a variety of processes.

One possibility is to provide the resulting suspension with a photosensitive additive which may comprise, for example, polyvinyl alcohol and sodium dichromate. Subsequently, the suspension is provided homogeneously on the inner side of the picture screen glass by means of spraying, dipping, or spin coating. The "wet" film is dried, for example, by means of heating, infrared radiation, or microwave radiation. The color filter layer thus obtained is exposed through a mask, and the exposed areas are cured. The non-exposed areas are washed away by spraying with water and thus removed.

Another possibility is the so-called lift-off process. Here first a photosensitive polymer layer is provided on the picture screen glass and subsequently exposed through a mask. The exposed areas are crosslinked, and the non-exposed areas are removed in a development step. The pigment suspension is deposited on the remaining polymer pattern on the inner side of the picture screen by means of spraying, dipping, or spin coating and is subsequently dried. The crosslinked polymer is converted into a soluble form by means of a reactive solution such as, for example, a strong acid. The polymer with the portions of the color filter layer present thereon is removed by spraying with a developer liquid, whereas the color filter layer adhering directly to the picture screen glass is not detached thereby.

Color filter layers having the same layer thickness are obtained by means of these methods in the regions of the green and the blue phosphor or in the regions of the green and the red phosphor. It may be advantageous, however, that the red or blue color filter layer in the region of the green phosphor has a smaller layer thickness than the red or blue color filter layer in the region of the blue or red phosphors, respectively. This may be achieved on the one hand in that the color filter layer in the region of the green phosphor is manufactured in a separate process step, or a non-linear photosensitive system is added to the suspension of the color filter pigment. A color filter layer with different layer thicknesses is obtained by means of exposure times of different lengths for the corresponding regions. Such a non-linear photosensitive system may comprise, for example, a polymer soluble in water such as polyvinyl alcohol (PVA) or polyvinyl pyrrolidone (PVP) which are sensitized by means of water-soluble bisazide derivatives such as, for example, sodium salts of diazostilbene, diazodibenzolactone or bisazidosulfobenzilidenecyclopentanone.

A further advantageous embodiment may be that the exposure of a color filter layer takes place from the outer side of the picture screen glass because the layers at the boundary surface with the picture screen glass become crosslinked first and show a particularly good adhesion.

A red color filter with the same layer thickness or with different layer thicknesses in the regions of the red and green phosphors and a blue color filter in the region of the blue phosphors can be applied through a suitable combination of the methods described. Similarly, a blue color filter with the same layer thickness or with different layer thicknesses in the regions of the blue and green phosphors and a red color filter in the region of the red phosphors may be provided.

Pigments used for a red color filter layer may be, for example, $Fe_2O_3$, TaON, or CdS—CdSe, and for a blue color filter, for example, CoO—$Al_2O_3$ or ultramarine.

As was shown by way of example in FIG. 1 for the pigments CoO—$Al_2O_3$ and $Fe_2O_3$, all these pigments are partly transparent in the emission range of the green phosphor ZnS:Cu,Au. Curve 1 corresponds to the transmission curve of CoO—$Al_2O_3$ and curve 2 to the transmission curve of $Fe_2O_3$.

To manufacture a color picture screen, for example, the picture screen glass may first be covered with the pattern of a black matrix in a photolithographical process. The color filter layers are provided on the picture screen glass by one of the methods described above such that these layers are positioned between the picture screen glass and the corresponding phosphor raster. Then the rasters of the three primary colors blue, red, and green are provided in three consecutive photolithographical steps with the use of suspensions of the respective phosphors. Alternatively, the phosphors may be provided in a printing process such as, for example, screen printing. The finished color picture screen comprising all three colors and the color filter layers may be provided with an aluminum film on the rear side for normal applications in color cathode ray tubes or color monitors.

A color picture screen according to the invention may be used, for example, for the manufacture of a color cathode ray tube which comprises a housing, a color picture screen, a neck, and a cone connecting the color picture screen to the neck, as well as an electron gun provided inside the neck for emitting at least one electron ray.

FIGS. 2 to 8 show the CIE color triangles of the red, blue, and green phosphors in a color cathode ray tube with and without subjacent color filters. The blue phosphor used was ZnS:Ag, the green phosphor ZnS:Cu,Au, and the red phosphor $Y_2O_2S$:Eu.

Embodiments of the invention will be described in detail below, representing examples of how the invention may be realized in practice.

Embodiment 1

To manufacture a red color filter layer, 750 g red iron oxide $Fe_2O_3$ was stirred into 4.25 1 of an aqueous solution of 37.5 g of a sodium salt of a polyacryl acid as a dispersing agent and 75 g of a 5% solution of a non-ionogenic antifoaming agent. A ball mill containing glass balls was filled for 50% with the previously dispersed $Fe_2O_3$ suspension and the speed was set for 75% of the critical speed. A stable suspension of the $Fe_2O_3$ particles with an average particle size of 105 nm was obtained.

After milling, the suspension was diluted with 3.8 l water and separated from the glass balls through a sieve gauze. The suspension containing $Fe_2O_3$ had a pigment concentration of 8.5%. The suspension thus obtained remained stable for a period of several weeks.

The layer thickness of the red color filter and the pigment concentration could be adjusted through dilution of the suspension containing $Fe_2O_3$. The suspension was provided on a picture screen glass previously structured with a photosensitive polymer layer of polyvinyl pyrrolidone by means of spin coating. The layer thicknesses of the red color filter layers were, depending on the degree of dilution, between 0.5 $\mu$m and 0.15 $\mu$m after drying, and the pigment concentration was 7.5% and 2.3% by weight. The remaining portions of the polymer layer were removed along with the color filter layer deposited thereon in a development step.

Embodiment 2

To manufacture a blue color filter layer, 60 g CoO—$Al_2O_3$ was stirred into a dispersing agent solution of 3.0 g of a sodium salt of a polyacryl acid in 400 ml water. The resulting suspension was milled in a ball mill with glass balls. The ball mill was filled for 50% and the speed was set for 60% of the critical speed. A stable suspension of pigment particles with an average particle size of 85 nm was obtained.

After milling, the suspension was diluted with water to a pigment concentration of 9% by weight and was separated from the glass balls through a sieve gauze. The suspension containing CoO—$Al_2O_3$ remained stable for a period of several weeks.

The suspension was mixed with a 10% solution of polyvinyl alcohol, and the viscosity was reduced to approximately 30 mPa*s through the addition of water. In addition, sodium dichromate was added to the suspension. The ratio of polyvinyl alcohol to sodium dichromate was 10:1.

The suspension was deposited on a picture screen glass by means of spin coating, and a transparent blue color filter layer of 1.0 $\mu$m layer thickness and with a pigment concentration of 3.2% by weight was obtained after drying. The layer was irradiated with UV light through a mask, whereby the polymer was crosslinked in the exposed regions. Subsequently, the non-crosslinked color filter areas were washed off by spraying with hot water.

The layer thickness and the pigment concentration of a blue color filter layer could be adjusted by means of the viscosity of the suspension. The layer thickness was between 3 $\mu$m and 0.15 $\mu$m after deposition and drying of the suspension, and the pigment concentrations were 7.5% and 3.5% by weight.

A blue color filter with CoO—$Al_2O_3$ with a layer thickness of 4 $\mu$m was manufactured in that the viscosity of the suspension containing CoO—$Al_2O_3$ was not reduced to below 50 mPa*s before the application on the picture screen glass, and the pigment concentration was kept at 6% by weight.

Embodiment 3

First a black matrix was provided on a picture screen glass in a photolithographical process. Then a structured red color filter layer with a layer thickness of 0.3 μm and a $Fe_2O_3$ pigment concentration of 4.5% by weight was provided in a manner as described in embodiment 1. Subsequently, a structured blue color filter layer was provided in a manner as described in embodiment 2. The layer thickness was 1 μm and the CoO—$Al_2O_3$ pigment concentration was 3.2% by weight. The phosphors were provided on the color filter layer by means of photolithographical processes. The blue phosphor used was ZnS:Ag, the green phosphor ZnS:Cu,Au, and the red phosphor was $Y_2O_2S$:Eu. The phosphors were deposited such that the red color filter layer lay between the red phosphor and the picture screen glass, and the blue color filter layer lay between the blue and green phosphors and the picture screen glass.

The color picture screen was used for manufacturing a color cathode ray tube which comprises a housing, a color picture screen, a neck, and a cone connecting the color picture screen to the neck, as well as an electron gun provided inside the neck for the emission of at least one electron ray.

Figure 2:
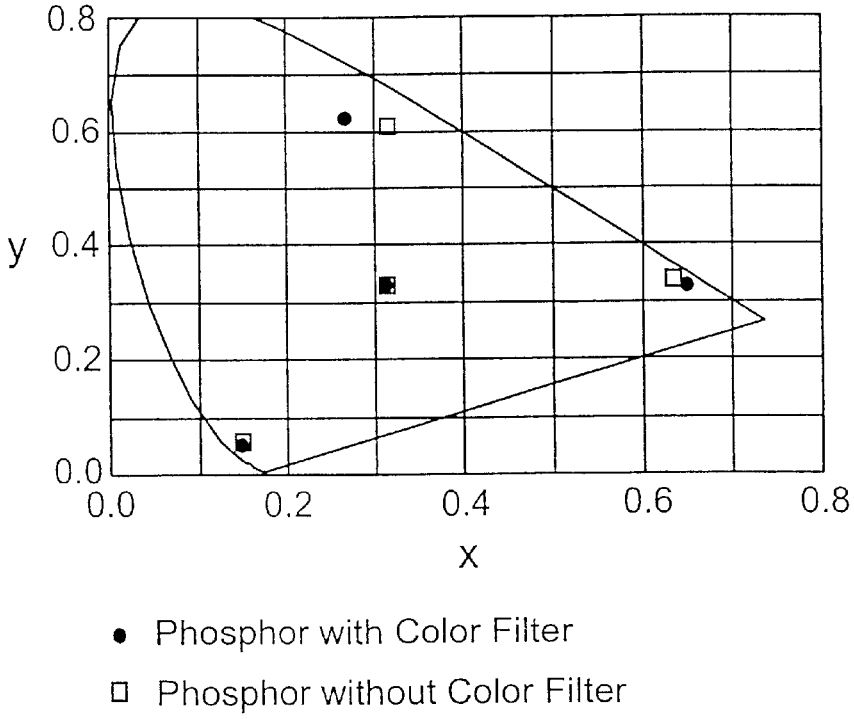

FIG. 2 shows the color coordinates of the phosphors with and without color filters in the CIE color triangle for an operating color cathode ray tube. The LCP value of the color cathode ray tube was increased by 15% in comparison with a color cathode ray tube having the same construction and the same phosphors, but no color filter layers. The color point of the reflected light was x=0.265, y=0.264.

Embodiment 4

First a black matrix was provided on a picture screen glass in a photolithographical process. Then a structured red color filter layer with a layer thickness of 0.5 μm and a pigment concentration of 7.5% by weight of $Fe_2O_3$ was provided in a manner as described in embodiment 1. Subsequently, a structured blue color filter layer was provided as described in embodiment 2. The layer thickness was 2 μm and the pigment concentration of CoO—$Al_2O_3$ was 7.5% by weight. The phosphors were provided on the color filter layer by means of photolithographical processes. The blue phosphor used was ZnS:Ag, the green phosphor ZnS:Cu,Au, and the red phosphor $Y_2O_2S$:Eu. The phosphors were deposited such that the red color filter layer lay between the red phosphor and the picture screen glass, and the blue color filter layer lay between the blue and green phosphors and the picture screen glass.

The color picture screen was used for manufacturing a color cathode ray tube which comprises a housing, a color picture screen, a neck, and a cone connecting the color picture screen to the neck, as well as an electron gun provided inside the neck for the emission of at least one electron ray.

Figure 3:
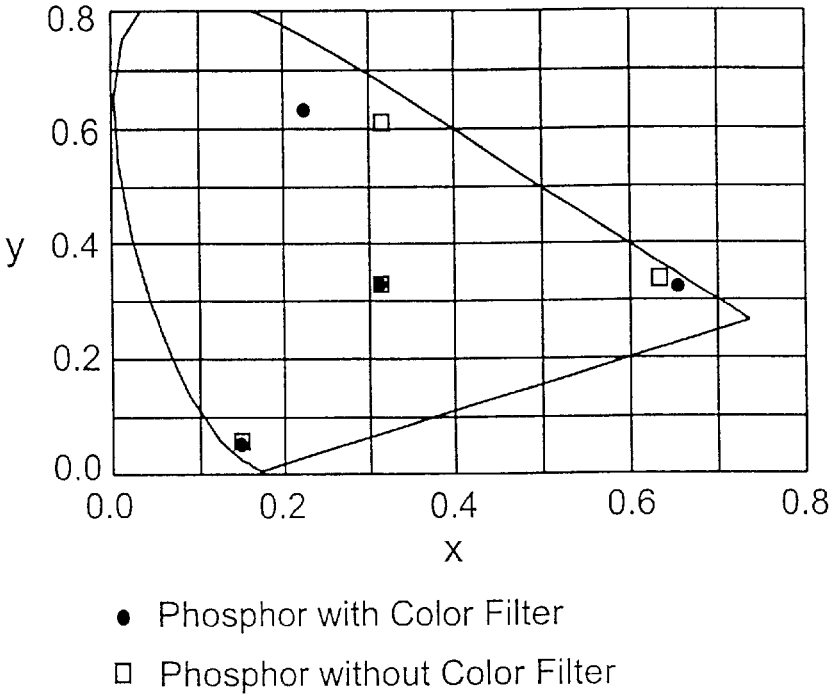

FIG. 3 shows the color coordinates of the phosphors with and without color filters in the CIE color triangle for an operating color cathode ray tube. The LCP value of the color cathode ray tube was increased by 14% in comparison with a color cathode ray tube having the same construction and the same phosphors, but no color filter layers. The color point of the reflected light was x=0.219, y=0.207.

Embodiment 5

First a black matrix was provided on a picture screen glass in a photolithographical process. Then a structured red color filter layer with a layer thickness of 0.4 μm and a $Fe_2O_3$ pigment concentration of 6% by weight was provided in a manner as described in embodiment 1. Subsequently, a first structured blue color filter layer was provided as described in embodiment 2. The layer thickness was 3 μm and the pigment concentration was 6% by weight of CoO—$Al_2O_3$. In addition, a second structured blue color filter layer was provided as described in embodiment 2. In this case the layer thickness was 0.6 μm. The phosphors were provided on the color filter layer by means of photolithographical processes. The blue phosphor used was ZnS:Ag, the green phosphor ZnS:Cu,Au, and the red phosphor $Y_2O_2S$:Eu. The phosphors were provided such that the red color filter layer lay between the red phosphor and the picture screen glass. The blue color filter layer with a layer thickness of 3 μm lay between the blue phosphor and the picture screen glass, and the blue color filter layer with a layer thickness of 0.6 μm lay between the green phosphor and the picture screen glass.

The color picture screen was used for manufacturing a color cathode ray tube which comprises a housing, a color picture screen, a neck, and a cone connecting the color picture screen to the neck, as well as an electron gun provided inside the neck for the emission of at least one electron ray.

Figure 4:
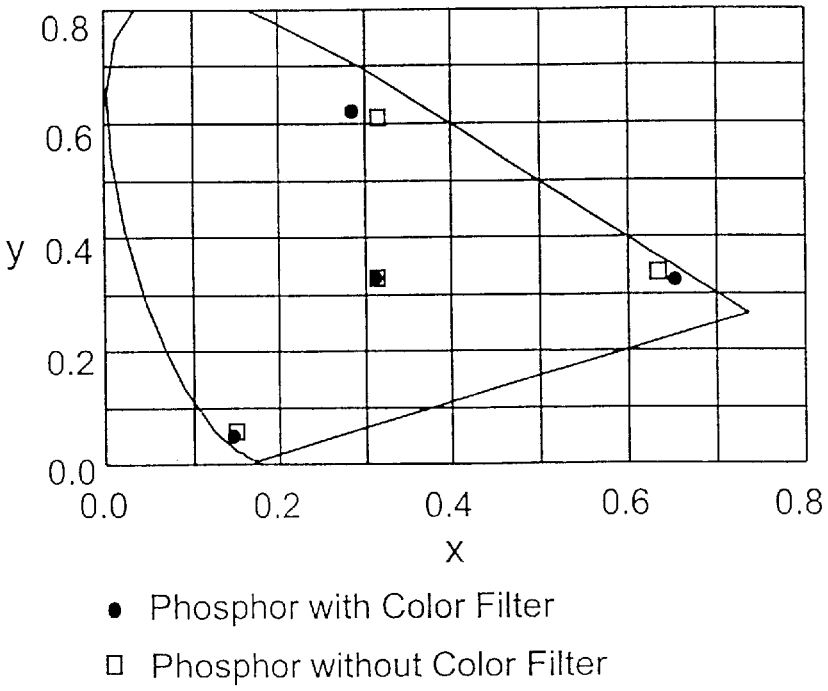

FIG. 4 shows the color coordinates of the phosphors with and without color filters in the CIE color triangle for an operating color cathode ray tube. The LCP value of the color cathode ray tube was increased by 27% in comparison with a color cathode ray tube having the same construction and the same phosphors, but no color filter layers. The color point of the reflected light was x=0.257, y=0.247.

Embodiment 6

A black matrix was first provided on a picture screen glass in a photolithographical process. Then a structured red color filter layer with a layer thickness of 0.15 μm and a pigment concentration of 2.3% by weight of $Fe_2O_3$ was provided in a manner as described in embodiment 1. Then a structured blue color filter layer was provided as described in embodiment 2. The layer thickness was 4 μm and the CoO—$Al_2O_3$ pigment concentration was 6% by weight. The phosphors were provided on the color filter layer in photolithographical processes. The blue phosphor used was ZnS:Ag, the green phosphor ZnS:Cu,Au, and the red phosphor $Y_2O_2S$:Eu. The phosphors were provided such that the red color filter layer lay between the red and green phosphors and the picture screen glass, and the blue color filter layer lay between the blue phosphor and the picture screen glass.

The color picture screen was used for manufacturing a color cathode ray tube which comprises a housing, a color picture screen, a neck, and a cone connecting the color picture screen to the neck, as well as an electron gun provided inside the neck for the emission of at least one electron ray.

Figure 5:
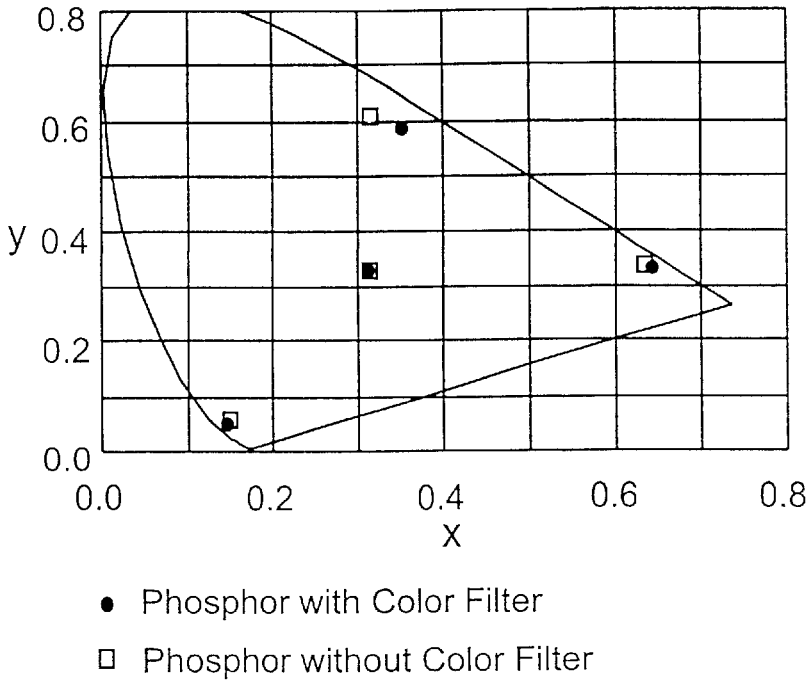

FIG. 5 shows the color coordinates of the phosphors with and without color filters in the CIE color triangle for an operating color cathode ray tube. The LCP value of the color cathode ray tube was increased by 25% in comparison with a color cathode ray tube having the same construction and the same phosphors, but no color filter layers. The color point of the reflected light was x=0.336, y=0.286.

Embodiment 7

First a black matrix was provided on a picture screen glass in a photolithographical process. Then a first structured red color filter layer with a layer thickness of 0.4 μm and a $Fe_2O_3$ pigment concentration of 6% by weight was provided in a manner as described in embodiment 1. In addition, a second structured red color filter layer was provided as described in embodiment 1. In this case, the layer thickness was 0.15 μm and the pigment concentration 2.3% by weight. Subsequently, a structured blue color filter layer was provided as described in embodiment 2. The layer thickness was 4 μm and the CoO—$al_2O_3$ pigment concentration was 6% by weight. The phosphors were provided on the color filter layer in photolithographical processes. The blue phosphor used was ZnS:Ag, the green phosphor ZnS:Cu,Au, and the red phosphor $Y_2O_2S$:Eu. The phosphors were provided such that the red color filter layer with a layer thickness of 0.4 μm lay between the red phosphor and the picture screen glass, the red color filter layer with a layer thickness of 0.15 μm lay between the green phosphor and the picture screen glass, and the blue color filter layer lay between the blue phosphor and the picture screen glass.

The color picture screen was used for manufacturing a color cathode ray tube which comprises a housing, a color picture screen, a neck, and a cone connecting the color picture screen to the neck, as well as an electron gun provided inside the neck for the emission of at least one electron ray.

Figure 6:
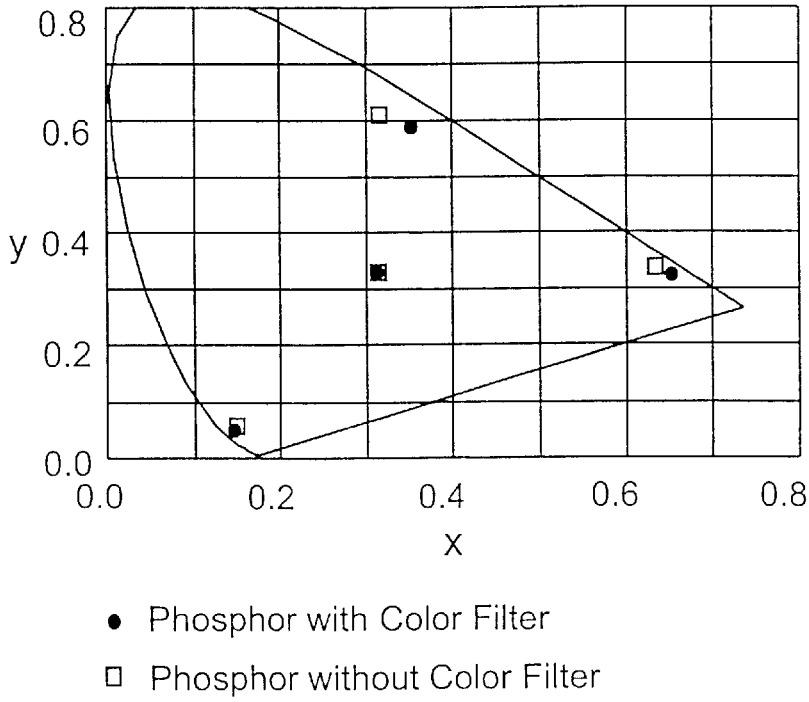

FIG. 6 shows the color coordinates of the phosphors with and without color filters in the CIE color triangle for an operating color cathode ray tube. The LCP value of the color cathode ray tube was increased by 34% in comparison with a color cathode ray tube having the same construction and the same phosphors, but no color filter layers. The color point of the reflected light was x=0.335, y 0.268.

Embodiment 8

First a black matrix was provided on a picture screen glass in a photolithographical process. Then a structured red color filter layer with a layer thickness of 0.4 $\mu$m and a $Fe_2O_3$ pigment concentration of 6% by weight was provided in a manner as described in embodiment 1. Subsequently, a first structured blue color filter layer was provided in a manner analogous to that described in embodiment 2. The layer thickness was 3 $\mu$m and the ultramarine pigment concentration was 6% by weight. In addition, a second structured blue color filter layer was provided as described in embodiment 2. In this case, the layer thickness was 0.3 $\mu$m. The phosphors were provided on the color filter layer in photolithographical processes. The blue phosphor used was ZnS:Ag, the green phosphor ZnS:Cu,Au, and the red phosphor $Y_2O_2S$:Eu. The phosphors were deposited such that the red color filter layer lay between the red phosphor and the picture screen glass, the blue color filter layer with a layer thickness of 3 $\mu$m lay between the blue phosphor and the picture screen glass, and the blue color filter layer with a layer thickness of 0.3 $\mu$m lay between the green phosphor and the picture screen glass.

The color picture screen was used for manufacturing a color cathode ray tube which comprises a housing, a color picture screen, a neck, and a cone connecting the color picture screen to the neck, as well as an electron gun provided inside the neck for the emission of at least one electron ray.

Figure 7:
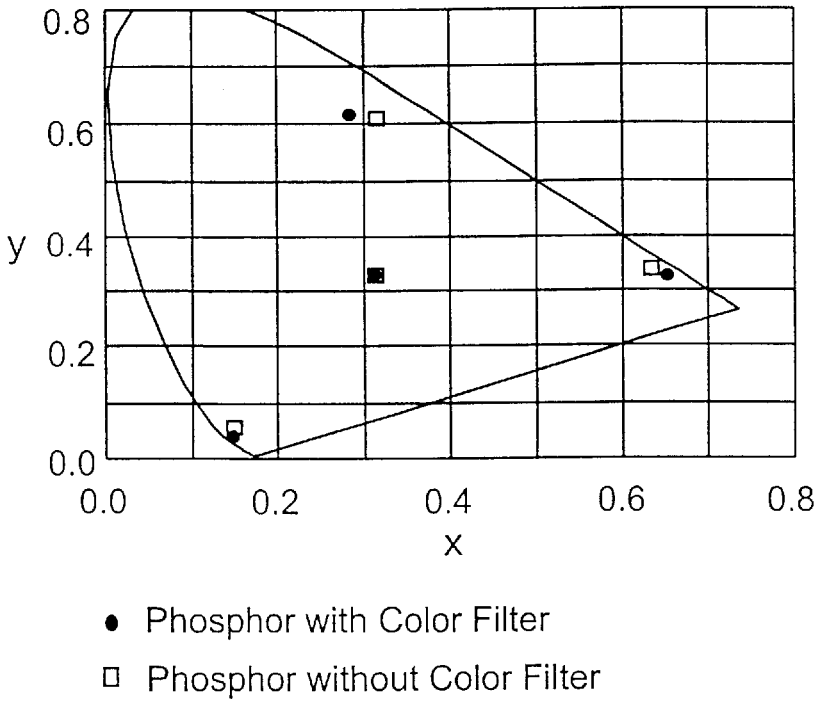

FIG. 7 shows the color coordinates of the phosphors with and without color filters in the CIE color triangle for an operating color cathode ray tube. The LCP value of the color cathode ray tube was increased by 35.5% in comparison with a color cathode ray tube having the same construction and the same phosphors, but no color filter layers. The color point of the reflected light was x=0.257, y=0.220.

Embodiment 9

First a black matrix was provided on a picture screen glass in a photolithographical process. Subsequently, a structured red color filter layer comprising TaON with a layer thickness of 2 $\mu$m was provided in a manner as described in embodiment 1. Then a first structured blue color filter layer with ultramarine was provided as in embodiment 2. The layer thickness was 3 $\mu$m and the ultramarine pigment concentration was 6% by weight. In addition, a second structured blue color filter layer was provided as described in embodiment 2. The layer thickness was 0.3 $\mu$m in this case. The phosphors were provided on the color filter layer in photolithographical processes. The blue phosphor used was ZnS:Ag, the green phosphor ZnS:Cu,Au, and the red phosphor $Y_2O_2S$:Eu. The phosphors were deposited such that the red color filter layer lay between the red phosphor and the picture screen glass, the blue color filter layer with a layer thickness of 3 $\mu$m lay between the blue phosphor and the picture screen glass, and the blue color filter layer with a layer thickness of 0.3 $\mu$m lay between the green phosphor and the picture screen glass.

The color picture screen was used for manufacturing a color cathode ray tube which comprises a housing, a color picture screen, a neck, and a cone connecting the color picture screen to the neck, as well as an electron gun provided inside the neck for the emission of at least one electron ray.

Figure 8:
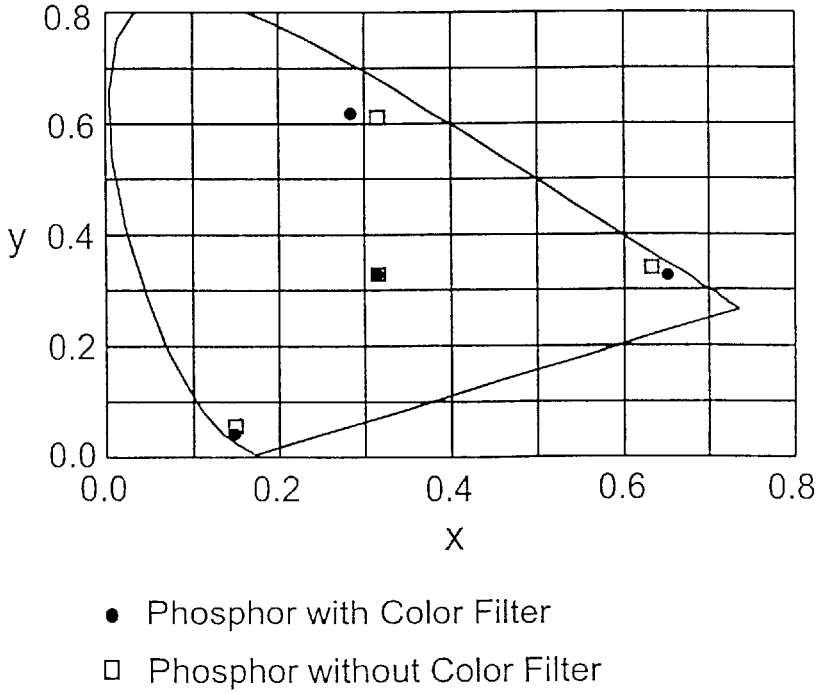

FIG. 8 shows the color coordinates of the phosphors with and without color filters in the CIE color triangle for an operating color cathode ray tube. The LCP value of the color cathode ray tube was increased by 40% in comparison with a color cathode ray tube having the same construction and the same phosphors, but no color filter layers. The color point of the reflected light was x=0.282, y=0.230.

What is claimed is:

1. A color picture screen provided with a picture screen glass, a phosphor layer which is provided on the inner surface of the picture screen glass and comprises red, green, and blue phosphors, and with a color filter layer between the picture screen glass and the phosphor layer, which color filter layer comprises a red color filter layer in the region of the red phosphors in the phosphor layer, a blue color filter layer in the region of the blue phosphors in the phosphor layer, and a blue or a red color filter layer in the region of the green phosphors.

2. A color picture screen as claimed in claim 1, characterized in that the thickness of the red color filter layer in the region of the green phosphors is smaller than the thickness of the red color filter layer in the region of the red phosphors.

3. A color picture screen as claimed in claim 1, characterized in that the thickness of the blue color filter layer in the region of the green phosphors is smaller than the thickness of the blue color filter layer in the region of the blue phosphors.

4. A color picture screen as claimed in claim 1, characterized in that the blue color filter layer comprises a pigment chosen from the group of CoO—$Al_2O_3$ and ultramarine pigments.

5. A color picture screen as claimed in claim 1, characterized in that the red color filter layer comprises a pigment chosen from the group of $Fe_2O_3$, TaON, and CdS—CdSe.

6. A color picture screen as claimed in claim 4 or 5, characterized in that the pigments have an average particle diameter smaller than 200 $\mu$m.

7. A color picture screen as claimed in claim 1, characterized in that a black matrix is provided on the picture screen glass.

* * * * *